US005919063A

United States Patent [19]

Wang

[11] Patent Number: 5,919,063

[45] Date of Patent: Jul. 6, 1999

[54] THREE ROW PLUG AND RECEPTACLE CONNECTORS WITH GROUND SHIELD

[75] Inventor: Bowin Wang, Taipei, Taiwan

[73] Assignee: Berg Technology, Inc.

[21] Appl. No.: 08/932,407

[22] Filed: Sep. 17, 1997

[51] Int. Cl.[6] ..... H01R 13/648

[52] U.S. Cl. ..... 439/608; 439/83; 439/108; 439/607

[58] Field of Search ..... 439/607, 108, 439/101, 608, 609, 181, 79, 374, 378, 83, 81

[56] References Cited

U.S. PATENT DOCUMENTS

| | | | |
|---|---|---|---|
| Re. 32,691 | 6/1988 | Dola et al. | 439/608 |
| Re. 35,508 | 5/1997 | Lemke et al. | 439/101 |
| 4,571,014 | 2/1986 | Robin et al. | 339/14 R |
| 4,824,383 | 4/1989 | Lemke | 439/108 |
| 5,057,028 | 10/1991 | Lemki et al. | 439/10 |
| 5,169,343 | 12/1992 | Andrews | 439/608 |
| 5,174,764 | 12/1992 | Kandybowski et al. | 439/83 |
| 5,199,880 | 4/1993 | Arai | 439/65 |
| 5,342,220 | 8/1994 | Kodama | 439/607 |
| 5,344,327 | 9/1994 | Brunker et al. | 439/108 |
| 5,399,105 | 3/1995 | Kaufman et al. | 439/609 |
| 5,645,436 | 7/1997 | Shimizu et al. | 439/108 |

*Primary Examiner*—Steven L. Stephan
*Assistant Examiner*—Michael C. Zarroli
*Attorney, Agent, or Firm*—M. Richard Page; Daniel J. Long

[57] ABSTRACT

An electrical plug and receptacle for terminating multiple electrical conductors is disclosed. The plug has a frame which includes first and second crossbars, first and second plates and a plurality of walls thereby defining first, second and third channels. First, second and third insulated support structures having forwardly extending fingers thereon are received in the channels. A plurality of contact elements are disposed on each of the fingers, thereby defining a row, so that the plug provides first second and third rows of contact elements. The receptacle also has a frame which is formed by a base plate, first and second walls extending toward the front of the receptacle, and third and fourth walls extending toward the rear of the receptacle. A number of passages are formed in the baseplate. A plurality of insulated support structures are positioned in the passages. A plurality of contact springs are disposed in each of the support structures so that the receptacle provides first second and third rows of contact springs. When mated, each contact spring forms an electrical connection with a corresponding contact element, thereby forming rows of electrically connected elements. When mated, the plug and receptacle frames serve to electrically isolate the rows of electrically connected elements. It is preferred for the plug and receptacle frames to be integrally formed as single piece metallic castings. The plug and receptacle also include structure for providing electrical isolation to the tails of the contact elements and contact springs. To this end an additional frame is provided between groups of tails, wherein the additional frame serves to extend the electrical isolation along the length of the tails to the point of mounting the tails to a printed circuit board. Right angle embodiments of the novel plug and receptacle are also disclosed.

29 Claims, 4 Drawing Sheets

THREE ROW PLUG AND RECEPTACLE CONNECTORS WITH GROUND SHIELD

FIELD OF THE INVENTION

The present invention relates to electrical connectors, and more particularly, to plug and receptacle connectors wherein the plug and receptacle are provided with multiple layers of contact elements and each layer is electrically isolated from other layers.

BACKGROUND OF THE INVENTION

The continued development of sophisticated electronic devices for data processing and communications systems is placing rigorous demands on electrical connectors. Increasing integration of solid state devices, combined with the need to increase the speed of data processing and communication systems, requires that connectors have higher densities, higher pin counts, and better electrical performance than in the past.

Density and pin count are often viewed interchangeably, but there are important differences. Density refers to the number of contacts provided per unit length. In contrast, the number of contact elements that can reasonably withstand the mating and unmating forces is referred to as the pin count.

As more functions become integrated on semiconductor chips or on flexible circuit substrates and more chips are provided on printed circuit boards (PCBs), each PCB or flexible circuit must provide more inputs and outputs (I/Os). The demand for more I/Os directly translates to a demand for greater density. In addition, many system components are capable of operation at faster speeds than previously. Faster speed can result in the generation of potentially interfering signals, i.e., crosstalk and noise. The connectors used in such high-speed board-to-board, board-to-cable and cable-to-cable communications may be treated for design purposes like transmission lines in which crosstalk and noise become significant concerns. Indeed, the electrical performance of high-speed board-to-board, board-to-cable and cable-to-cable communications is dependent upon the amount of crosstalk and noise introduced at the connector interface. As density increases, the potential for crosstalk and noise at the connector interface also increases.

Density, contact element count, and electrical performance are related to one another. Design factors should be balanced to optimize the connector in terms of its density, contact element count and electrical performance. Density can be increased by decreasing the distance between contact elements and by increasing the number of rows in a connector. Increasing the density may also increase the contact element count because 1) more contact elements are available for mating and unmating, and 2) higher density reduces the linear tolerances per contact element as mating and unmating forces are averaged over more contact elements. An increase in contact element density may, however, adversely affect the electrical performance of the connector since crosstalk can increase by bringing the contact elements into closer proximity to one another. The contact element count is limited in part by the mechanical forces applied when the connector is mated and unmated.

As was recognized in U.S. Pat. No. 4,824,383—Lemke, incorporated herein by reference, an important connector design consideration is the provision of an electrical connection while avoiding degradation of component performance. Prior to this patent, connector designs had been proposed in which a ground plane and alternating ground contacts together with shielding extensions were introduced to minimize electrical discontinuities, i.e., crosstalk and noise. While performance was controlled in such prior devices, density was limited.

U.S. Pat. No. 4,824,383 proposed designs for plug and receptacle connectors for multiple conductor cables or multiple trace substrates. In such designs individual contact elements or groups of contact elements were electrically isolated to prevent or minimize crosstalk and signal degradation. In the individually isolated design, a conductive base plate was provided with a number of walls arranged in side-by-side relationship, thereby defining a number of channels. A contact support member formed from electrical insulating material was designed to have a number of fingers, wherein a finger was positioned within each channel. Each finger of the contact support member supported an individual contact element. In the group isolated design, the base plate and walls defined channels for isolating sets of contact elements. Each set was carried by an enlarged finger of the contact support member. In this embodiment the base plate and walls were said to provide a ground plane to each contact element group, resulting in impedance control and lowered cross-talk. Both the individually isolated design and the group isolated design included a cover or shell formed from a conductive material, thereby providing additional isolation.

Although, the connectors disclosed in U.S. Pat. No. 4,824,383 increased contact element density, industry driven density demands continued to grow. In relation to meeting such demands, it was believed advantageous to provide an interconnection between the ground structure of the plug and receptacle connectors, to provide a structure to the receptacle that eliminated loose fits between the receptacle and contact element carrier and to provide a plug and receptacle whose interengaged signal contacts were disposed more closely to electrical ground. U.S. Pat. Nos. 5,057,028—Lemke et al. and 5,169,324—Lemke et al. (now U.S. Pat. No. Re. 35.508), all incorporated herein by reference, proposed designs to meet those objectives. In those patents, two row plug and receptacle connectors are described for attachment to printed circuit boards (PCBs), so that when such connectors are mated the PCBs are electrically interconnected.

The plug is described as preferably including a die-cast, metallic frame member having upper and lower crossbars connected at opposite ends by uprights. A central plate extends between the uprights in a plane generally parallel to the crossbars. The frame thereby defines two channels, namely upper and lower channels. The upper and lower channels are each described as being further divided by a central wall. Contact elements are embedded in extended fingers of insulating material. The extended fingers are inserted into each channel against the central plate and oriented such that the planar portion of each contact element is exposed. The contact elements thereby form two rows facing away from the central plate towards the crossbars. Tail portions of the contact elements extend rearwardly through partitions formed of insulating material for attachment to a PCB.

The receptacle is described as including a die-cast, metallic frame having an open front and rear. The frame includes upper and lower crossbars which are interconnected at corresponding ends by uprights. A central plate extends across the frame between the uprights in a generally planar relationship to the crossbars. The frame thereby defines two channels, namely upper and lower channels. The upper and lower channels are in turn divided at the midpoint by a further upright, thereby defining four sub-channels. A pair of insulating nosepieces are mounted to the front of the frame. A contact block, formed from insulating material, is designed to fit within each subchannel. Curve shaped, electrical contact springs are imbedded into each contact block. The number and design of the contact springs corresponds to the number and design of the contact elements in the plug. When a contact block is fitted into the receptacle frame, the curved contact end of each contact spring is positioned within a window formed in the nosepiece. Each window is designed to receive and support the curved forward end of the contact spring. The contact springs thereby form two rows wherein the curved portion of each contact spring faces away from the crossbars towards the central plate. The tail portions of the contact springs extend rearwardly from the contact block for attachment to a PCB.

As the plug and receptacle components are brought together, they are guided into aligned engagement by cooperative interaction between tapered ends, the central wall and guide slots. Such interaction serves to accurately align the contact elements in the plug with the contact springs in the receptacle.

While the connectors described above serve to satisfy certain density needs in the industry, industry driven density demands still continue to grow. Therefore, there is still a need to provide higher density plugs and receptacles which are capable of transmitting high frequency signals without degradation.

In meeting this continuing need, the present invention not only includes a novel connector structure that provides for increased contact element density, but also, permits connectors of this type to interconnect two PCBs in generally the same plane. In achieving this latter feature, the plug and receptacle of the connector are designed for right angle mounting, i.e., the front of the plug or receptacle is oriented in a plane at substantially a right angle to the PCB on which the plug or receptacle is mounted. Examples of right angle connectors have been proposed in the past, for example the connectors disclosed in U.S. Pat. Nos. 5,399,105—Kaufman et al., 5,169,343—Andrews, and Re. 32,691—Dola et al. However, none of those connectors are designed for nor concerned with high density contact elements.

SUMMARY OF THE INVENTION

The above described problems are resolved and other advantages are achieved in an electrical plug and receptacle for terminating multiple electrical conductors. The plug includes a frame having a top wall, a bottom wall, first and second intermediate walls, a center wall and end walls. The end walls maintain the top, bottom, and intermediate walls in spaced relationship. This arrangement of walls defines first, second and third channels. First, second and third insulated support structures are provided, which have forwardly extending fingers. Each of the fingers is received in one of the first, second or third channels. A plurality of contact elements are disposed on each of the fingers, thereby defining a row. Each of the contact elements is connectable to one of the conductors. With this structure, the plug provides first second and third rows of contact elements. The frame is connectable to an electrical potential.

It is preferred for the plug walls to be integrally formed and for the frame to be formed from a single metallic casting.

The plug also can include an extension member, located proximate the first and second intermediate walls, for electrically extending the isolation provided by such walls to the tails of the contact elements. The extension member includes first and second side walls and end walls, wherein one edge of each of the first and second side walls is positioned proximate the first and second intermediate walls. It is also preferred to provide a tail guide formed from insulating material. A plurality of bores formed in the tail guide serve to arrange the tails of the contact elements in a pattern.

The contact elements include a wiper portion and a tail portion defining an angle therebetween. In certain embodiments, the contact elements include a bend so that the wiper and tail portions are at an angle greater than 180 degrees to one another, and, in one embodiment, approximately 270 degrees.

The receptacle includes a frame formed from a base plate, first and second walls, mounted to the base plate and extending toward the front of the receptacle, and third and fourth walls mounted to the base plate and extending toward the rear of the receptacle. The base plate has a number of passages therethrough, wherein the passages are located on both sides of the first wall. A plurality of insulated support structures adapted to receive a plurality of contact springs therein are positioned in the passages. A plurality of contact springs are disposed in each of the support structures. Each contact spring is connectable to one of the conductors. When the support structures are positioned in the passages, the receptacle provides first second and third rows of contact springs.

It is preferred for the receptacle walls to be integrally formed and for the frame to be formed from a single metallic casting.

The receptacle also can include an extension member, located proximate the third and fourth walls, for electrically extending the isolation provided by such walls to the tails of the contact elements. The extension member includes a second base plate having walls formed thereon. Each of the walls is positioned proximate the third and fourth walls. It is also preferred to provide a tail guide formed from insulating material. A plurality of bores formed in the tail guide serve to arrange the tails of the contact elements in a pattern.

The contact springs include a wiper portion and a tail portion defining an angle therebetween. In certain embodiments, the contact elements include a bend so that the wiper and tail portions are at an angle greater than 180 degrees to one another, and, in one embodiment, approximately 270 degrees.

An electrical connector system is shown to include a first connector having three arrays of contact elements and first and second conductive walls separating the three arrays of contact elements and a second connector having three arrays of contact elements and third and fourth conductive walls separating the three arrays of contact elements. The second connector is adapted to mate with the first connector so that the contact elements of the first and second connectors form electrical connections therebetween and so that the conductive walls are brought to within a predetermined distance from each other thereby reducing crosstalk between adjacent arrays of contact elements.

BRIEF DESCRIPTION OF THE DRAWINGS

The present invention will be better understood and its numerous objects and advantages will become apparent by reference to the following detailed description of the invention when taken in conjunction with the following drawings, in which.

DETAILED DESCRIPTION OF THE INVENTION

Figure 1:
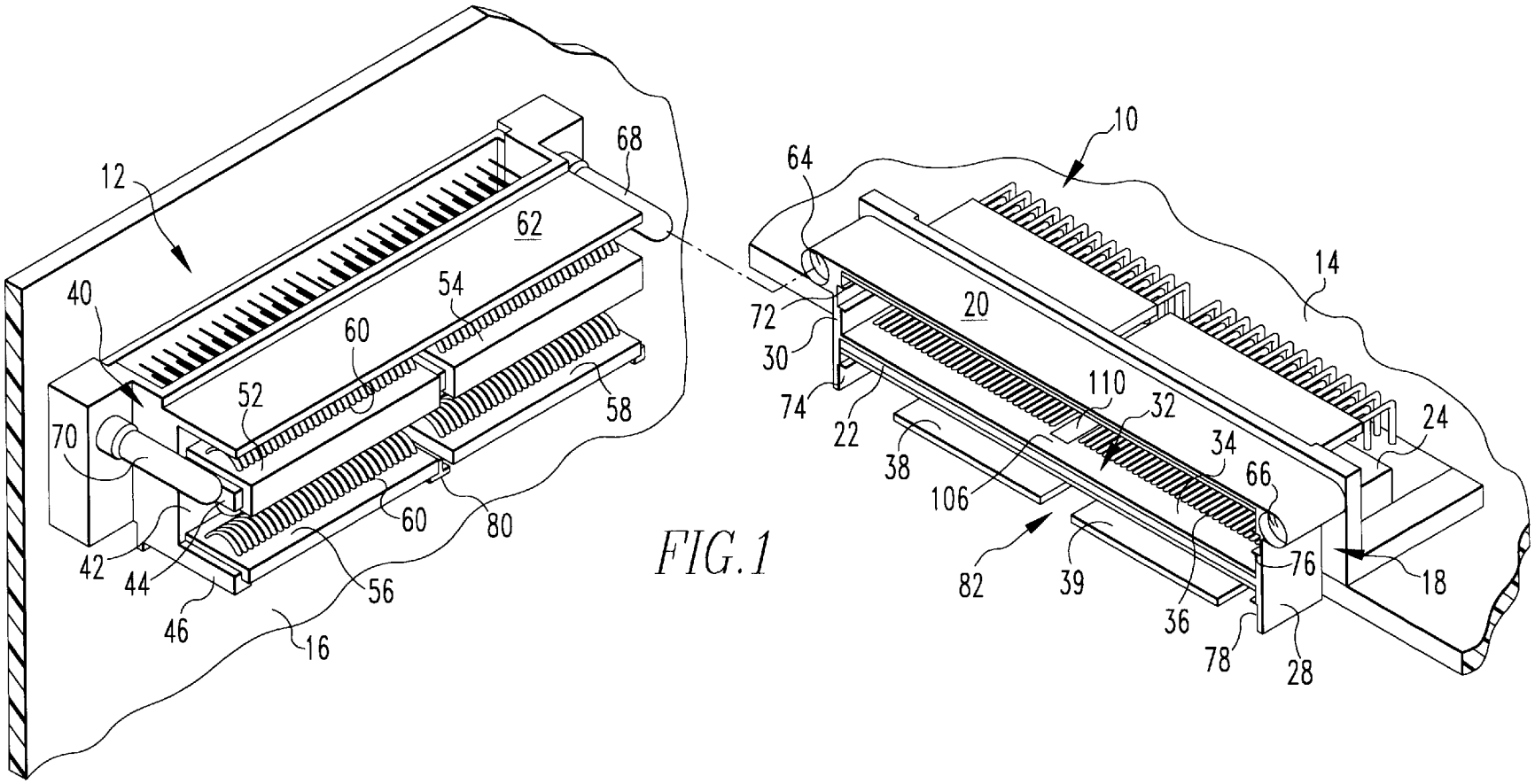
FIG. 1 is a perspective view generally depicting a plug and a receptacle constructed in accordance with the present invention.

An electrical connector system constructed in accordance with the present invention is generally shown in FIG. 1. The connector system is seen to include two major components. A plug 10 and a receptacle 12. It is noted that plug 10 and receptacle 12 will find particular use as terminators for terminating components containing multiple electrical conductors, i.e. cables or traces on circuit boards. Due to the relatively large number of electrical conductors now forming transmission cables, such conductors are typically splayed and connected to a printed circuit board (PCB). By attaching plug 10 and receptacle 12 to PCBs 14 and 16 the contact elements mounted in such devices are capable of being connected to one or more of the multiple conductors. Because splaying and connection of multiple conductors to a PCB is known and does not form a part of the present invention, it is not described in any greater detail herein.

Considering first plug 10, it is seen to include several major components. A frame 18 includes a first crossbar or top wall 20, a second crossbar or bottom wall 22, a first plate 24, a second plate 26 (shown in FIGS. 3 and 4) and end walls 28 and 30. End walls 28 and 30 serve to maintain walls 20, 22, 24 and 26 in spaced relationship to one another. This arrangement of walls defines a number of channels which will be described in greater detail in relation to FIG. 2. In the preferred embodiment, the walls of frame 18 are integrally formed. It is especially preferred to form such walls as a single metallic casting.

Plug 10 also includes a number of insulated support structures. Only one support structure 32 is shown in FIG. 1. Support structure 32 includes a forwardly extending finger 34. A plurality of contact elements 36 are disposed on finger 34 thereby defining a row of contact elements. As will be described below, each contact element includes a tail which extends rearwardly from frame 18 and is connected to PCB 14. Thus, each contact element 36 is connectable to one of the electrical conductors. Plug 10 is also shown to include plates 38 and 39, the purpose of which will be explained in greater detail below.

Consider now receptacle 12 shown in FIG. 1. Similar to plug 10, receptacle 12 includes a frame 40. Frame 40 is formed from base plate 42 and walls 44 and 46. Walls 44 and 46 are mounted to the base plate and extend towards the front of receptacle 12. Additional walls 48 and 50, shown more clearly in FIG. 7, are also attached to base plate 42, however, these walls extend toward the rear of receptacle 12. As will be described in greater detail in relation to FIGS. 6 through 8, base plate 42 includes a number of passages, wherein such passages are located on both sides of wall 44 and on only one side of wall 46.

Similar to plug 10, receptacle 12 also includes a plurality of insulated support structures. Only structures 52, 54, 56, and 58 are shown. Each of these support structures is adapted to receive a plurality of contact springs, wherein the array of contact springs disposed within a support structure define a row of contact springs. As will be discussed in greater detail below, the contact springs extend rearwardly through base plate 42 for attachment to PCB 16. In this manner, each contact spring is connectable to one of the conductors for which receptacle 12 is serving as a terminator.

Similar to plug 10, it is preferred for walls 44, 46 and base plate 42 to be integrally formed. It is especially preferred for frame 40 to be formed as a single piece of metallic casting. In the embodiment shown in FIG. 1, frame 40 also includes wall 62. It will be appreciated that high density connectors such as plug 10 and receptacle 12 will require alignment so that each contact element 36 will wipe against and make electrical contact with a single contact spring 60. To this end, various alignment structures are provided. For example, frame 18 includes cylindrical bores 64 and 66. When plug 10 is inserted into receptacle 12, bore 64 slides on post 68 and bore 66 slides on post 70. In this manner, gross alignment is provided. FIG. 1 also discloses slots 72 and 74 formed in end wall 30 and slots 76 and 78 formed in end wall 28. As plug 10 is inserted into receptacle 12, the ends of wall 44 slide within slots 72 and 76 while the ends of wall 46 slide within slots 74 and 78. In this manner, further alignment is provided.

Still further alignment is provided by the sliding contact between the inside surface of wall 62 and the outside surface of wall 20 and the inside surface of walls 38 and 39 and the outside surface of wall 46. Additional alignment is provided by the center portion 80 of wall 44 passing in the gap 82 between walls 38 and 39. Additional alignment for plug 10 and receptacle 12 is described below. However, by means of the previously and below described alignment mechanisms, independent electrical connection is established between a single contact element and a single contact spring.

Figure 2:
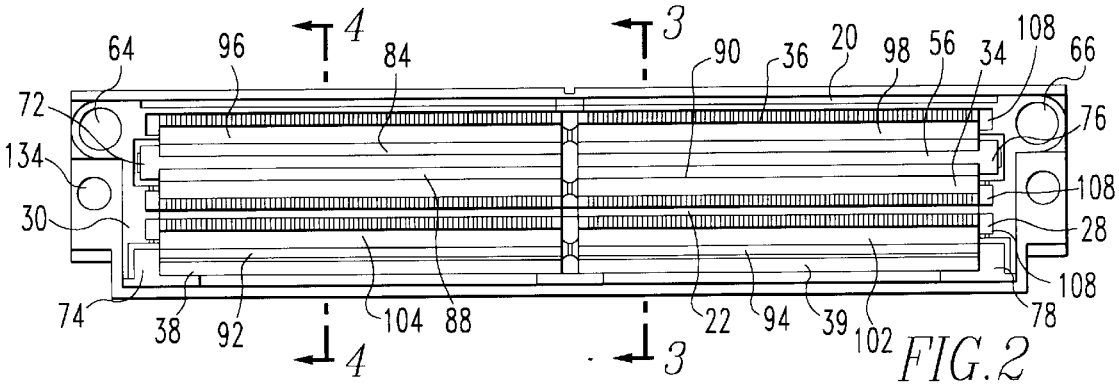
FIG. 2 is a front elevational assembly view of the plug of the plug depicted in FIG. 1.
Figure 3:
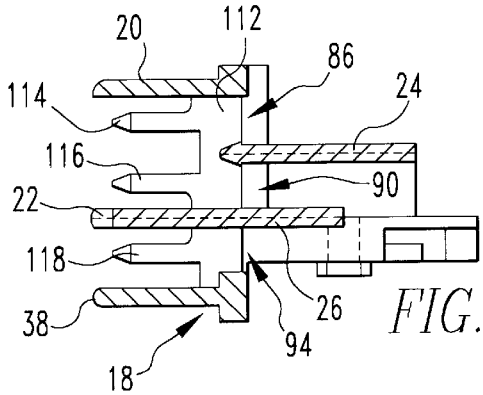
FIG. 3 is a sectional view of only the frame of the plug depicted in FIG. 2 taken along the line 3—3.
Figure 4:
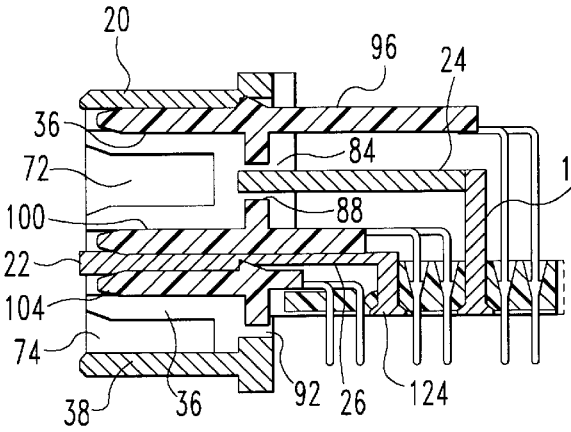
FIG. 4 is a sectional taken along the line 4—4 in FIG. 2.

Referring now to FIGS. 2–4, plug 10 will be described in greater detail. As described previously, frame 18 includes a number of passages 84, 86, 88, 90, 92 and 94. Insulated support structure 34, previously shown in FIG. 1, is positioned within passage 90. The other insulated support structures are positioned as follows: structure 98 is in passage 86; structure 96 is in passage 84; structure 100 is in passage 88; structure 102 is in passage 94; and structure 104 is in passage 92. It will be appreciated from FIG. 2, and also from FIG. 4, that support structures 96 and 98 are oriented within their respective passages, so that the wiper or forward portion of contact elements 36 face away from and are insulated from wall 20. Similarly support structures 102 and 104 are oriented within passages 94 and 92 so that the wiper portion of contact element 36 faces away from wall 22 and towards wall 38. Finally, support structures 34 and 100, positioned within passages 90 and 88, respectively, are oriented such that the wiper portion of contact element 36 faces away from wall 22 towards wall 20. It is noted at this point, and as can be seen in reference to FIG. 1, that insulated support structures 34 and 100 are integrally formed, being joined by a small web portion 106. Support structures 96 and 98 are integrally joined in a similar manner as are support structures 102 and 104. In an especially preferred embodiment of plug 10, in order to assure precise orientation of support structures and corresponding contact elements, the ends of the support structures slide within guide slots 108 formed in end walls 28 and 30. Additionally, slot 110, formed by joining two support structures with web portion 106 (shown in FIG. 1) receives center wall 112, shown in FIG. 3.

Referring specifically to FIG. 3, center wall 112 is shown to include a number of posts 114, 116 and 118. As will be described in relation to FIG. 6, when plug 10 and receptacle 12 are joined, posts 114–118 serve to provide further alignment and serve to provide additional electrical isolation between groups of contact elements.

Referring now specifically to FIG. 4, it will be seen that each contact element 36 is provided with a tail for mounting to a PCB (not shown). As will be appreciated from viewing FIGS. 2 and 4, three rows of contact elements are provided by plug 10. The first row of contact elements consists of those arrays of contact elements mounted to support structures 96 and 98. The second row of contact elements consists of those arrays of contact elements mounted to support structures 34 and 100 and the third row of contact elements are those elements mounted to support structures 102 and 104. One of the features of the present invention is that each row of contact elements is electrically isolated from other rows of contact elements when frame 18 is connected to an electrical potential, preferably ground potential. This electrical isolation feature occurs for both the forward or wiper part of the contact element as well as the tail of the contact element. Referring to the tail portion of the contact element, it will be seen from FIG. 4 that intermediate walls 24 and 26 extend rearwardly from frame 18 thereby electrically isolating a portion of the tails contained in the three rows of contact elements. In order to complete the electrical isolation of the rows of contact elements, an additional isolating member 120 is provided.

Figure 5:
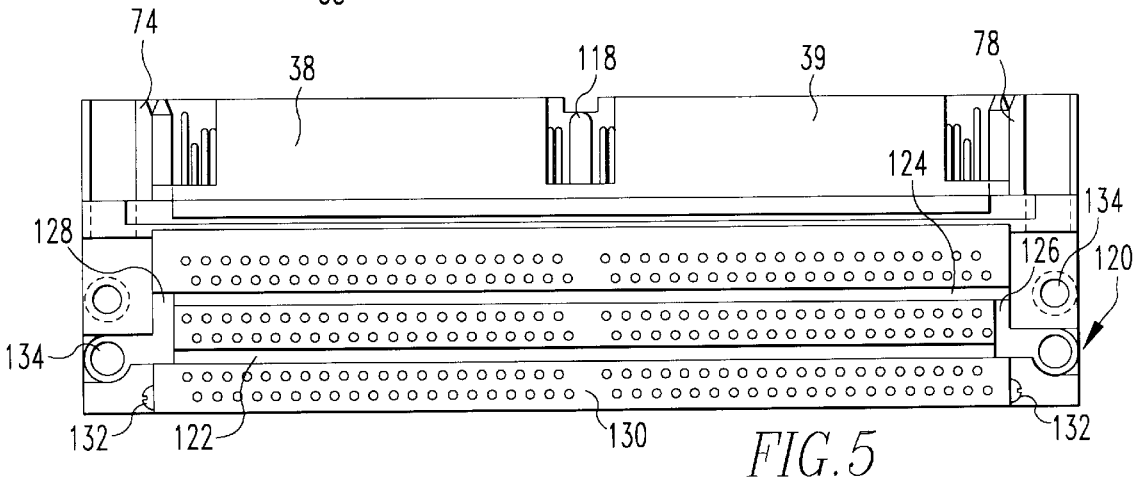
FIG. 5 is a bottom view of the plug depicted in FIG. 2.

Referring to FIGS. 4 and 5, member or frame 120 is shown to include walls 122 and 124 which are maintained in spaced relation to each other by end walls 126 and 128. When positioned as shown in the Figures, frame 120 serves to extend the electrical isolation between the tail portions of the contact element rows from the ends of walls 24 and 26 to the point at which the tails are mounted to a PCB. It is preferred for frame 120 to be integrally formed as a single metallic casting.

As shown in FIG. 4, the tail portions of contact elements 36 are bent at a right angle. For purposes of explanation, plug 10 can be considered as having an insertion direction and a mounting direction. The insertion direction is that direction which plug 10 moves in order to be inserted into receptacle 12, i.e. a direction from frame 18 toward the front of plug 10. The mounting direction is that direction which permits plug 10 to be mounted to a printed circuit board, i.e. that direction which parallels the bores in the PCB in which the tails are to be mounted. As shown in FIG. 4, an angle greater than 180° exists between the insertion direction and the mounting direction. Preferably this angle is approximately 270°. In this regard, plug 10 is a right angle plug.

In order to assure that the tails of contact elements 36 are arranged in a pattern which will match the pattern of bores contained on the PCB, a tail guide 130 is provided. Guide 130 is preferably formed from insulating material and has a plurality of bores passing there through. As will be seen in FIGS. 4 and 5, each tail portion of a contact element 36 passes through an individual bore in guide 130. In order to insure proper positioning of guide 130 in frame 18, key dimples 132 are provided. Key dimples 132 are designed to fit within appropriate recesses formed in frame 18. As shown in FIG. 4, guide 130 includes a pair of channels through which walls 122 and 124 of member 120 extend. Thus, electrical isolation is further provided to the tails of contact elements 36 as they pass through guide 130.

Finally, mounting bores 134 are provided in frame 18 for the mounting of assembled plug 10 to PCB 14.

Figure 6:
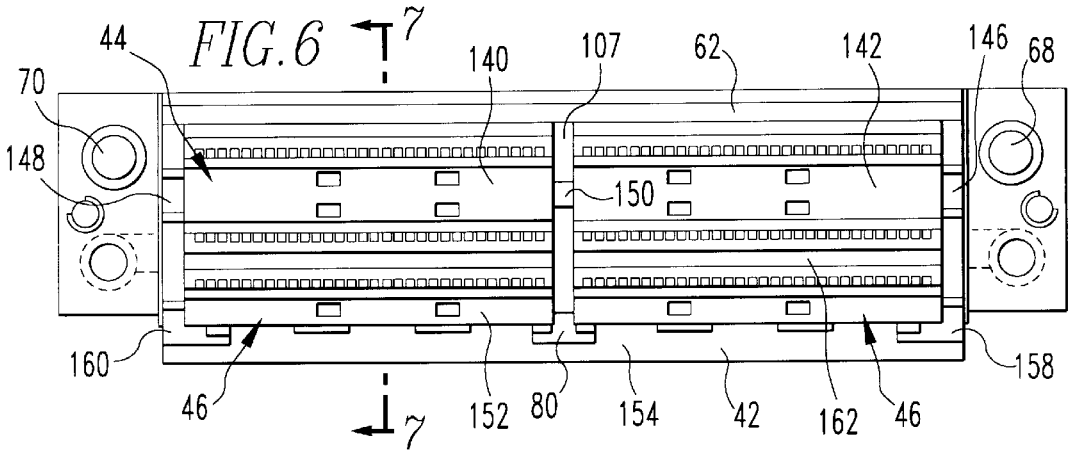
FIG. 6 is a front elevational assembly view of the receptacle depicted in FIG. 1.
Figure 7:
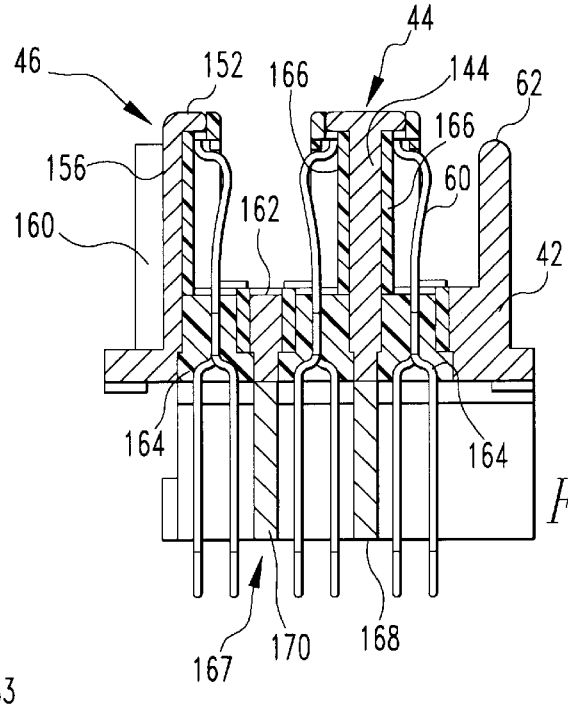
FIG. 7 is a sectional taken along the line 7—7 in FIG. 6.

Referring now to FIG. 6, receptacle 12 will be described in greater detail. It will be recalled from FIG. 1 that receptacle 12 includes a frame 40 having a base plate 42. Walls 44 and 46 are attached to baseplate 42 and extend forward towards the front of receptacle 12. As shown in FIG. 6 and FIG. 7, wall 44 includes several components, namely cap 140 and 142, support wall 144, end portions 146 and 148 and central portion 150. Preferably, the components of wall 44 are integrally formed as a part of the single piece, metallic receptacle casting referenced previously. Similarly, wall 46 includes cap members 152 and 154, support wall 156, center alignment post 80 and angle ends 158 and 160. As described previously, when plug 10 and receptacle 12 are joined, end members 146 and 148 will slide within slots 72 and 76 of plug 10, while angled ends 158 and 160 will move within slots 74 and 78 of plug 10.

As will be appreciated from FIG. 7, frame 40 has several passages formed therein. In particular, a passage is formed between wall 62 and support wall 144. A second passage is formed between support wall 144 and a fourth or intermediate wall 162. A third passage is formed between wall 162 and wall 156. It is noted that these passages extend across base plate 42. As shown in FIG. 6, these passages are essentially divided in half by central wall 164. As was noted in connection with FIG. 1, a number of insulated support structures (52, 54, 56, and 58) are inserted into these passages. As will be seen in FIG. 7, the insulated support structures also include several components.

As shown in FIG. 7, the insulated support structures include a base member 164 from which extend fingers 166. Base members 164 and fingers 166 are adapted to receive a plurality of contact springs 60. To this end a portion of contact spring 60 is embedded in base member 164. The forward end of the contact spring extends forward from base member 164 and is captured in the end portion of finger 166. It is noted that the end of spring number 60 is free to move within a pocket formed at the end of finger 166. Each contact spring 60 is also provided with a tail which extends rearwardly from base member 164.

As explained above, one of the features of the present invention, is that the contact springs are arranged in rows and that such rows are electrically isolated from one another. As shown in FIG. 7, three rows of contact springs are provided, wherein one row is provided on one side of support wall 144 and oriented so that the curved end or spring portion of the contact spring faces wall 62. Another row of contact springs is provided on the other side of support wall 144 and oriented so that the spring portion faces wall 46. A third row of contact springs is provided adjacent support wall 156 and oriented so that the spring element is facing towards support wall 144. Support wall 144 and wall 162 serve to electrically isolate the contact springs when frame 40 is connected to an electrical potential, preferably ground potential. In order to electrically isolate the tail portions of contact spring 60, an isolation extension frame 167 is provided. As shown in FIG. 7, frame 167 includes walls 168 and 170. In order to maintain electrical isolation, one edge of walls 168 and 170 is positioned proximate or in contact with the end of wall 144 and 162. Walls 168 and 170 can thus be considered as extending the isolation of walls 144 and 162. In an especially preferred embodiment, frame 167 is integrally formed as a metallic casting.

Figure 8:
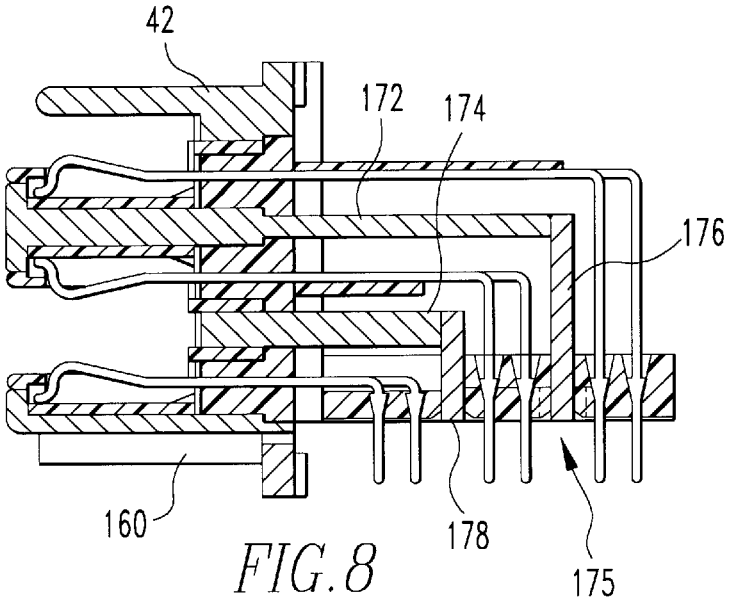
FIG. 8 shows an alternative embodiment of the receptacle depicted in FIG. 7.

Referring now to FIG. 8, an alternative embodiment of receptacle 12 is depicted. As shown in FIG. 8, the tail portions of contact spring 60 are bent at a right angle. Similar to plug 10, for purposes of explanation, receptacle 12 can be considered as having an insertion direction and a mounting direction. The insertion direction is that direction in which receptacle 12 receives plug 10, i.e., a direction from the front of receptacle 12 toward base plate 42. The mounting direction is that direction which permits receptacle 10 to be mounted to a printed circuit board, i.e. that direction which parallels the bores in the PCB in which the tails are to be mounted. As shown in FIG. 7, an angle approximately equal to 180° exists between the insertion direction and the mounting direction while in FIG. 8, an angle greater than 180° exists between the insertion direction and the mounting direction. For the receptacle shown in FIG. 8, preferably this angle is approximately 270°. In this regard, the receptacle shown in FIG. 8, is a right angle receptacle.

In order to maintain electrical isolation between the tails of the rows of contact springs depicted in FIG. 8, support wall 172 and wall 174 extend rearwardly from base plate 42 between the tails of the contact springs. Walls 172 and 174 generally correspond to support wall 144 and wall 162 shown in FIG. 7. In order to maintain the electrical isolation beyond the bend portion of the tail elements, an isolation extension frame 175 is provided. Frame 175 includes walls 176 and 178 which are maintained in spaced relationship by end walls 180 and 182 (shown in FIG. 9). It is especially preferred for extension member 175 to be integrally formed as a single metallic casting, similar to member 120 described in relation to FIGS. 4 and 5. Similarly, it is especially preferred for walls 168 and 170, shown in FIG. 7, to form a part of a single extension member.

Figure 9:
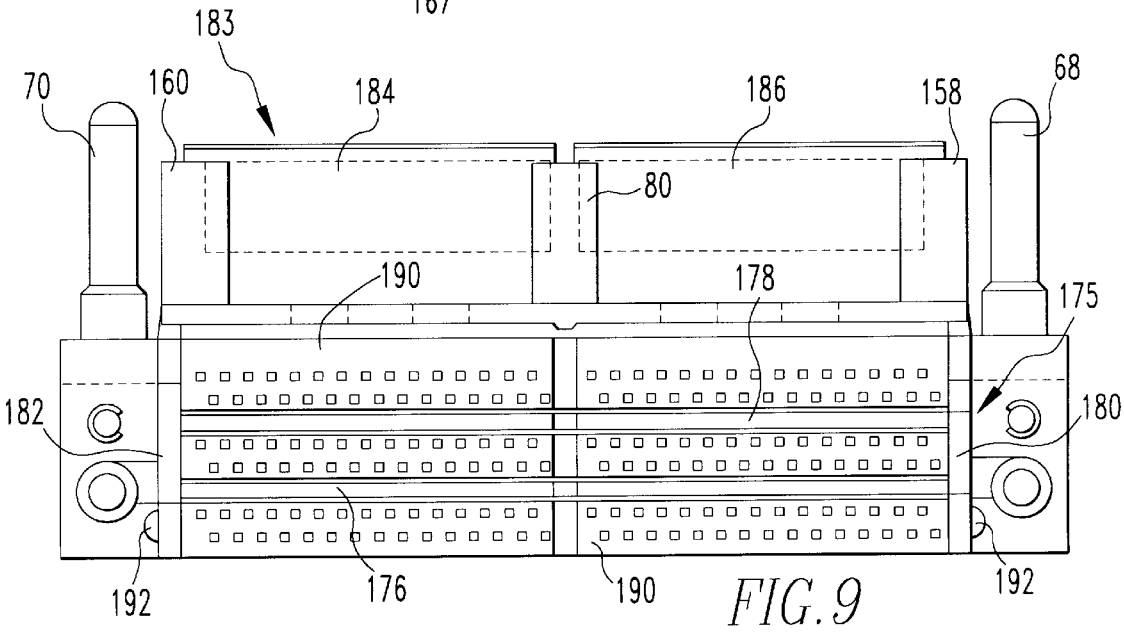
FIG. 9 is a bottom view of the receptacle depicted in FIG. 8.

Referring now specifically to FIG. 9, a bottom view of the embodiment shown in FIG. 8 is depicted. As shown in FIG. 9, wall 183 includes support walls 184 and 186. Wall 184 generally corresponds to wall 156 shown in FIG. 7. Although not shown in FIG. 7, a support wall corresponding to wall 186 is included in the embodiment of receptacle 12 shown in that Figure.

In order to assure that the tails of contact spring 60 are arranged in a pattern which will match the pattern of bores on a PCB, a tail guide 190 is provided. Guide 190 is preferably formed from insulating material and has plurality of bores arranged in a particular pattern passing there through. As will be seen in FIGS. 8 and 9, each tail portion of a contact spring 60 passes through a individual bore in guide 190. In order to insure proper positioning of guide 190 in base plate 42, key dimples 192 are provided. Dimples 192 are designed to fit within appropriate recesses formed in frame 40. Similar to guide 130, guide 190 includes a pair of channels through which walls 176 and 178 pass. Thus electrical isolation is provided to the tails of contact spring 60 as they pass through guide 190.

Figure 10:
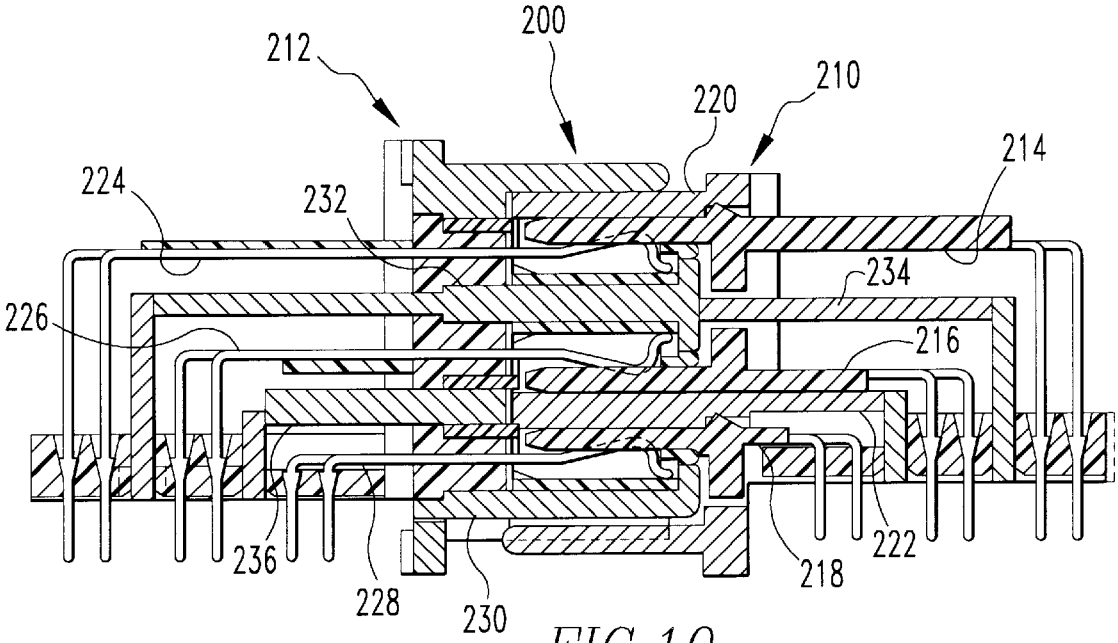
FIG. 10 is a section view of the receptacle depicted in FIG. 8 into which the plug of FIG. 4 has been inserted.

Referring now to FIG. 10, an electrical connector system 200 is shown to include a plug portion 210 and a receptacle portion 212. Plug portion 210 corresponds to plug 10 shown in FIG. 4 and receptacle portion 212 corresponds to the embodiment of receptacle 12 shown in FIG. 8. As shown in FIG. 10, plug 210 includes three arrays of contact elements 214, 216 and 218. Plug 210 is also shown to include conductive walls 220 and 222. Receptacle 212 is shown to include three arrays of contact springs 224, 226 and 228. Receptacle 212 is also shown to include conductive walls 230 and 232 which separate the three arrays of contact springs. Plug 210 and receptacle 212 are adapted to mate with each other so that the arrays of contact elements 214, 216 and 218 form electrical connections with the arrays of contact springs 224, 226 and 228. Moreover, when mated, conductive walls 220, 232, 222 and 230 are sandwiched with contact elements and contact springs disposed therebetween, thereby reducing crosstalk between adjacent arrays. It will also be seen that conductive wall 232 extends to within a closer predetermined distance with conductive wall 234. A similar arrangement exists between conductive wall 222 and wall 236. The close proximity of the ends of these walls to one another forms a so-called "choke" joint, explained in greater detail in U.S. Pat. Nos. 5,057,028 and 5,169,324 (Re. 35,508).

While the invention has been described and illustrated with reference to specific embodiments, those skilled in the art will recognize that modification and variations may be made without departing from the principles of the invention as described hereinabove and set forth in the following claims.

What is claimed is:

1. An electrical plug for terminating multiple electrical conductors, said plug comprising:

a frame, said frame comprising first and second crossbars, a first plate, a second plate and first and second walls positioned in generally transverse relation to said first and second crossbars and said first and second plates to maintain said first and second crossbars and said first and second plates in spaced relationship, wherein said first plate is located closer to said second crossbar than to said first crossbar and wherein said second plate is located closer to said first crossbar than to said second crossbar, wherein said arrangement of crossbars and plates define first, second and third channels and wherein said frame is connectable to a predetermined electrical potential;

first, second and third insulated support structures having forwardly extending fingers thereon, each of the fingers being received in one of said channels; and a plurality of contact elements being disposed on each of the fingers, thereby defining a row, each of the contact elements being connectable to one of the conductors, so that said plug provides first, second and third rows of contact elements.

2. An electrical plug for terminating multiple electrical conductors, said plug comprising:

a frame comprising a top wall, a bottom wall, first and second intermediate walls, a center wall and end walls, wherein said end walls maintain said top, bottom, and intermediate walls in spaced relationship, wherein said arrangement of walls defines first, second and third channels and wherein said frame is connectable to an electrical potential;

first, second and third insulated support structures having forwardly extending fingers thereon, each of the fingers being received in one of said first, second and third channels; and a plurality of contact elements being disposed on each of the fingers, thereby defining a row, each of the contact elements being connectable to one of the conductors, so that said plug provides first, second and third rows of contact elements.

3. The plug of claim 2, wherein said top wall, bottom wall, first and second intermediate walls, center wall and end walls are integrally formed as a single metallic member.

4. The plug of claim 3, wherein said frame comprises a metallic casting.

5. The plug of claim 2, wherein said contact elements comprise tails for mounting on a printed circuit board.

6. The plug of claim 5, further comprising an extension member, wherein said extension member is located proximate said first and second intermediate walls, so that said intermediate walls are electrically extended thereby.

7. The plug of claim 6, wherein said extension member comprises first and second side walls and end walls, wherein one edge of each of said first and second side walls is positioned proximate said first and second intermediate walls.

8. The plug of claim 5, further comprising a tail guide formed from insulating material, said tail guide having a plurality of bores passing therethrough, wherein said tails pass through said bores.

9. The plug of claim 2, wherein said contact elements comprise a wiper portion and a tail portion, wherein said wiper and tail portions define an angle therebetween.

10. The plug of claim 9, wherein said contact elements include a bend so that said wiper and tail portions are at an angle greater than 180 degrees to one another.

11. The plug of claim 10, wherein said angle is 270 degrees.

12. An electrical receptacle for terminating multiple electrical conductors, said receptacle comprising:

a frame formed of a base plate, first and second walls mounted to said base plate and extending toward the front of said receptacle, and third and fourth walls mounted to said base plate and extending toward the rear of said receptacle, said base plate having a number of passages therethrough, wherein said passages are located on both sides of said first wall;

a plurality of insulated support structures adapted to receive a plurality of contact springs therein, said contact support structures being positioned in said passages; and a plurality of contact springs being disposed in each of the support structures, each of the contact springs being connectable to one of the conductors, so that when said support structures are positioned in said passages, said receptacle provides first second and third rows of contact springs.

13. The receptacle of claim 12, wherein said first, second, third and fourth walls are integrally formed as a single metallic member.

14. The receptacle of claim 13, wherein said frame comprises a metallic casting.

15. The receptacle of claim 12, wherein said contact elements comprise tails for mounting on a printed circuit board.

16. The receptacle of claim 15, wherein said third and fourth walls are located between said passages so that said tails extending from said first, second and third row of contact springs are divided by said third and fourth walls.

17. The receptacle of claim 16, wherein said base plate further comprises end walls and wherein said third and fourth walls extend a sufficient distance toward said end walls as to be electrically connected thereto.

18. The receptacle of claim 15, wherein said receptacle further comprises a second base plate and wherein said third and fourth walls are formed on said second base plate.

19. The receptacle of claim 15, further comprising an extension member, wherein said extension member is located proximate said third and fourth walls, so that said third and fourth walls are electrically extended thereby.

20. The receptacle of claim 19, wherein said extension member comprises first and second side walls and end walls, wherein one edge of each of said first and second side walls is positioned proximate said third and fourth walls.

21. The receptacle of claim 15, further comprising a tail guide formed from insulating material, said tail guide having a plurality of bores passing therethrough, wherein said tails pass through said bores.

22. The receptacle of claim 12, wherein said contact springs comprise a wiper portion and a tail portion, wherein said wiper and tail portions define an angle therebetween.

23. The receptacle of claim 22, wherein said contact spring include a bend so that said wiper and tail portions are at an angle greater than 180 degrees to one another.

24. The receptacle of claim 23, wherein said angle is 270 degrees.

25. An electrical connector system, comprising:

a first connector having three arrays of contact elements and first and second conductive walls separating said three arrays of contact elements;

a second connector having three arrays of contact elements and third and fourth conductive walls separating said three arrays of contact elements; and said second connector adapted to mate with said first connector so that said contact elements of said first and second connectors form electrical connections therebetween and so that said conductive walls are brought to within a predetermined distance from each other so as to form a low impedance electrical current transmission line between said conductive walls and thereby reduce crosstalk between adjacent arrays of contact elements.

26. The system of claim 25, wherein said first connector is a receptacle and said second connector is a plug.

27. The system of claim 25, wherein said first connector is a receptacle comprising:

an insulative contact block for supporting at least a portion of an array of said contact elements;

a conductive frame in which said insulative contact block is received; and said first conductive plate being integrally formed with said conductive frame.

28. In a terminator for multiple electrical conductors of the type having a first ground structure formed of a baseplate with a first plurality of walls thereon cooperating to define a predetermined number of channels arranged in side-by-side relationship;

a number of insulated support structures having forwardly extending fingers formed thereon, each of the support structures being received in one of the channels; and electrical contact elements being disposed on each of the fingers, each of the contact elements having a tail extending rearwardly from said ground structure, whereby a group of tails extends rearwardly from each of said support structures, so that, in use, said ground structure is connectable to a predetermined electrical potential whereby the electrical contact elements are electrically isolated from each other;

the improvement comprising;

a second ground structure formed of a second baseplate with a second plurality of walls thereon cooperating to define a passage, wherein said second ground structure is positioned so that at least one of said groups of tails passes through said passage and positioned so that said second plurality of walls electrically cooperates with said first plurality, whereby, said group of tails passing through said passage are electrically isolated from the other tails.

29. An electrical connector system, comprising:

a first connector having three arrays of contact elements and first and second conductive walls separating said three arrays of contact elements;

a second connector having three arrays of contact elements and third and fourth conductive walls separating said three arrays of contact elements; and said second connector adapted to mate with said first connector so that said contact elements of said first and second connectors form electrical connections therebetween and so that said conductive walls are brought to within a predetermined distance of about 0.005 inch from each other thereby reducing crosstalk between adjacent arrays of contact elements.

* * * * *